US005096567A

United States Patent [19]

Paspek, Jr. et al.

[11] Patent Number: 5,096,567

[45] Date of Patent: Mar. 17, 1992

[54] HEAVY OIL UPGRADING UNDER DENSE FLUID PHASE CONDITIONS UTILIZING EMULSIFIED FEED STOCKS

[75] Inventors: Stephen C. Paspek, Jr., Broadview Hts.; Jeffery B. Hauser, Middleburg Hts.; David J. H. Smith, Bainbridge, all of Ohio

[73] Assignee: The Standard Oil Company, Cleveland, Ohio

[21] Appl. No.: 421,898

[22] Filed: Oct. 16, 1989

[51] Int. Cl.[5] ..... C10G 9/34

[52] U.S. Cl. ..... 208/106; 208/188; 208/125; 208/313; 208/311; 210/634

[58] Field of Search ..... 210/634; 208/188, 106, 208/311, 125, 313

[56] References Cited

U.S. PATENT DOCUMENTS

| | | | |
|---|---|---|---|
| 3,480,332 | 11/1969 | Kuhre et al. | 210/634 |
| 3,948,754 | 4/1976 | McCollum et al. | 208/438 |
| 4,056,462 | 11/1977 | Li et al. | 210/634 |
| 4,199,446 | 4/1980 | Clough | 210/634 |
| 4,216,079 | 8/1980 | Newcombe | 208/188 |
| 4,370,238 | 1/1983 | Tackett, Jr. | 208/188 |
| 4,795,478 | 1/1989 | Layrisse et al. | 252/312 |

*Primary Examiner*—Helane E. Myers

*Attorney, Agent, or Firm*—Larry W. Evans; David J. Untener; Scott A. McCollister

[57] ABSTRACT

A process for upgrading heavy hydrocarbons in an emulsion through dense phase processing. The process involves subjecting a feed of oil in an immiscible solvent emulsion to supercritical conditions to facilitate separation of the heavy hydrocarbons into light hydrocarbons with greater value and more uses.

26 Claims, 1 Drawing Sheet

HEAVY OIL UPGRADING UNDER DENSE FLUID PHASE CONDITIONS UTILIZING EMULSIFIED FEED STOCKS

BACKGROUND OF THE INVENTION

This invention relates to economical upgrading of heavy oils, particularly heavy hydrocarbons, into lighter more valuable, more useful hydrocarbons. More specifically, this invention relates to a process of reacting emulsified heavy oil to form light oils, including naphtha and kerosene, plus other valuable organic products. This process is particularly well suited for use in upgrading heavy oil emulsified in water to valuable and commercially exploitable light hydrocarbons.

The total quantity of discovered heavy oil-in-place is estimated to be at least 4,500 billion barrels. By comparison, reserves of conventional oil are presently estimated to be about 700 billion barrels (recoverable). However, heavy crude oils, bitumen, tar sands, and shale oil are difficult to recover, transport and process economically, because they are exceptionally viscous. For example, heavy crude may be up to a million times more viscous than water. A solution to the problems presented by this high viscosity would provide the key to unlock massive world hydrocarbon resources.

Several methods have been suggested for the transportation of such crude by pipeline, however, emulsifying heavy crude and water has proven to be the most effective. Emulsifying the oil and water is effectively accomplished through a staged process. In the first stage, heavy oil and water containing low concentrations of a commercially available surfactant are mixed together. This process forms polyhedral shaped oil droplets separated by thin films of aqueous surfactant solution. In the second stage, diluent water is added to reduce the viscosity of the emulsion to the 50–100 mPa.s range. The emulsions contain oil droplets with a narrow, well-defined and controllable size range. This has advantages for both transportation (allows operators to meet pipeline viscosity specifications without adding expensive diluent, while maintaining stable emulsions during tanker and pipeline transportation) and combustion (as fuels for boilers and heaters).

These emulsions, represent an elegant solution to the problem of transporting viscous hydrocarbons. A useful state-of-the-art review of heavy oil/water emulsion technology is given in U.S. Pat. No. 4,776,977 herein incorporated by reference.

European Patent Application 0301766 teaches suitable uses for the emulsified oil and water emulsions. Emulsions of highly viscous fuel oils and water are frequently as much as 3–4 orders of magnitude less viscous than the oil itself and consequently are much easier to pump and require considerably less energy to do so. Furthermore, since the oil droplets are already in an atomized state, the emulsified fuel oil is suitable for use in low pressure burners and requires less preheating, resulting in savings in capital costs and energy. In addition, these fuel oil emulsions burn efficiently with low emissions of both particulate matter and $NO_x$. This is an unusual and highly beneficial feature of the combustion.

Prior to the present invention, fuel combustion was the primary usage envisioned for the great quantity of oil/water emulsions available from high viscosity oil. However, to truly make the world's largest oil reserves (4,500 billion barrels of heavy oil) a valuable resource, an economically feasible means for directly treating the emulsified oil/water to obtain more valuable, more useful light hydrocarbons must be found.

Traditionally, heavy oil has been converted to lighter more valuable hydrocarbons through processes such as catalytic cracking, coking, and thermal cracking. These techniques, however, result in a great deal of highly refractory materials. Hydrocracking, has also been employed, however, the capital expenditures, due to the requirement of hydrogen plants, fuel, and feed for the production of hydrogen or a source of hydrogen are extremely high. Furthermore, all of these techniques have had extensive problems with contaminants often found in heavy oils, including $NO_x$. These contaminants are both environmentally destructive and often ruin the catalysts used in traditional heavy crude oil upgrading processes.

An alternative technique for recovering relatively low boiling hydrocarbons from heavy oil is supercritical-fluid extraction (dense fluid extraction). The basic principals of supercritical-fluid extraction are outlined in the Kirk Othmer Encyclopedia of Chemical Technology, 3rd Edition, John Wiley & Sons, Supplemental Volume, pp. 872–893 (1984).

Dense fluid extraction occurs due to the strong effects of slight pressure and temperature changes upon a fluid solvent in its critical region resulting in extremely large changes in solvent density and therefore in its dissolving power. Close to its critical point, the density of a fluid is extremely sensitive to these changes, and as a result of density changes the solvent powers of the fluid fluctuate. Dense fluid extraction functions more effectively than the prior art technologies, because the excellent solubility of a solvent under supercritical pressures allows superb extraction and separation characteristics. Selective extraction occurs during exposure of the solvent to the solute, while separation occurs when the pressure is reduced and the solvent density returns to that of a gaseous state, allowing the solutes to separate from solution depending upon their volatility. Both the extraction stage and the separation stage can be controlled to obtain optimum separation. For example mild conditions (pressure and temperature) can be used to extract or separate highly volatile materials, and the conditions can be gradually increased in intensity to extract or separate less volatile materials.

In general, dense fluid extraction at elevated temperatures can be considered as a better alternative to distillation at high temperature because, the destruction of conventional cracking or coking reactions does not occur, and environmental conditions are improved.

A useful state-of-the-art review of dense phase upgrading of hydrocarbons is given in U.S. Pat. No. 3,948,754. In that patent, a process is disclosed for recovering hydrocarbons from oil shale or tar sand solids and simultaneously cracking, hydrogenating, desulfurizing, demetallizing, and denitrifying the recovered hydrocarbons. This process comprises contacting the oil shale or tar sands solids with a water containing fluid at a temperature from about 600° F. to about 900° F. at super-atmospheric pressure in the absence of externally supplied hydrogen. This process, however, does not solve the problem associated with transporting the heavy hydrocarbons, oil shale, or tar sand solids from the production site to a processing facility and thus requires the processing facility to be located at the production site. As discussed previously, the oil reserves of this nature are generally remotely located and building production sites at these remote locations is economically unacceptable. The method of the present invention incorporates emulsified transportation technology with a dense fluid processing system to provide a direct process for treating an emulsified oil feedstock to obtain higher valued light hydrocarbon products. Furthermore, the use of an emulsified oil feedstock of the present invention has been demonstrated to produce significantly better results in upgrading heavy oils in comparison to processes utilizing simple non-emulsified oil/solvent mixtures.

SUMMARY OF THE INVENTION

It is a primary object of this invention to provide a new process for upgrading heavy oils, in particular heavy hydrocarbons, including bitumen, tar sands extract, and shale oil, to produce light, useful, more valuable hydrocarbons.

It is a further object of this invention to provide a new process for upgrading a heavy oil emulsion to produce more valuable light hydrocarbon products such as naphtha and kerosene.

This invention provides the means for directly producing valuable light hydrocarbons (relatively low boiling point) from an emulsion of viscous less valuable heavy oil (relatively high boiling point) and an immiscible solvent. This is significant in that the process utilizes heavy oil, bitumen, tar sands extract, or shale oil as available after transport in emulsion form. An emulsion is a stable mixture of two or more immiscible liquids held in suspension by small percentages of substances call emulsifiers. There is high economic value associated with this invention due to the input of low value oil and the output of desirable light hydrocarbons. The economic benefit derived from the product light hydrocarbons far outweighs the utility achieved previously from emulsified heavy oil through simple combustion. Furthermore, the efficiency of the present invention allows upgrading to occur anywhere, and not solely at the production site.

Additional objects and advantages of the invention will be set forth in part in the description that follows and in part will be obvious from the description, or may be learned by practice of the invention. The objects and the advantages of the invention may be realized and achieved by means of the instrumentalities and combinations particularly pointed out in the appended claims.

To achieve the foregoing objects and in accordance with the purpose of the invention as embodied and broadly described herein, the process of this invention comprises a process for upgrading heavy oils to light oils comprising heating an emulsion comprising heavy oil and an immiscible solvent under super critical pressure to at least about its critical temperature, to produce an upgraded product.

In a preferred embodiment, the process of the present invention includes recovering the light oils from the upgraded product.

In a further preferred embodiment, the process of the present invention includes fractionating the recovered upgraded product to obtain light oils.

In a still further preferred embodiment, the process of the present invention includes reducing the pressure prior to fractionating the upgraded product.

BRIEF DESCRIPTION OF THE DRAWINGS

The invention consists in the novel parts, construction, arrangements, combinations and improvements shown and described. The accompanying drawing which is incorporated and constitutes a part of this specification illustrates one embodiment of the invention and, together with the description, serve to explain the principles of the invention.

DETAILED DESCRIPTION OF THE INVENTION

Figure 1:
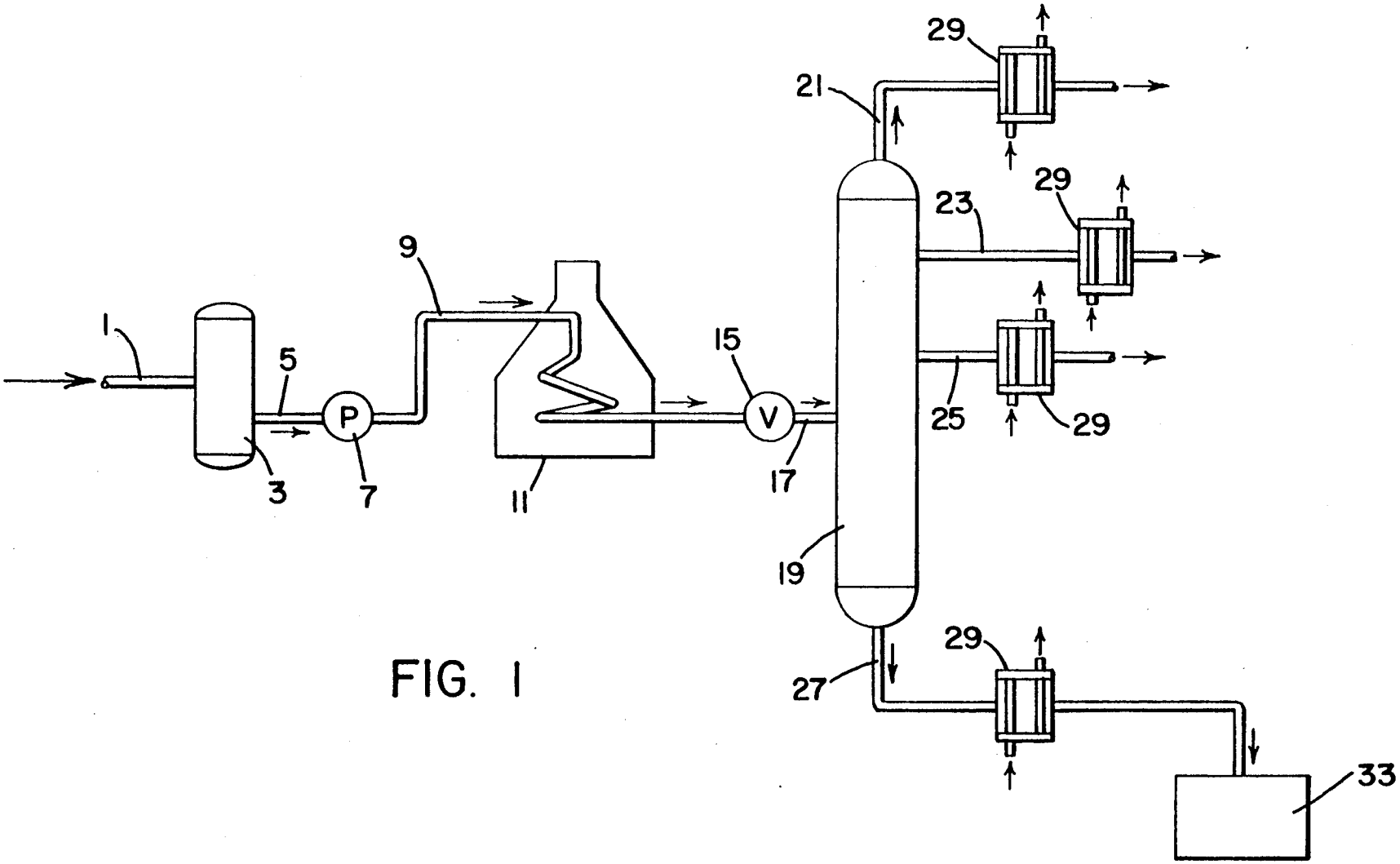
FIG. 1 is a schematic view of the reaction process assembly.

While the invention will be described in connection with a preferred embodiment, it will be understood that it is not intended to limit the invention to that embodiment. On the contrary, it is intended to cover all the alternatives, modifications and equivalence as may be included within the spirit and scope of the invention defined by the appended claims.

The oil and immiscible solvent emulsion used as feed stock should comprise between 50%-98% intermediate by volume of a viscous oil (e.g. crude) having a viscosity in the range of 200-250,000 mPa.s with 50%-2% by volume of immiscible solvent and emulsifying surfactant. Preferably 60%-95% viscous oil and 40%-5% immiscible solvent and surfactant. More preferably 70%-95% viscous oil and 30%-5% immiscible solvent and surfactant. Most preferably, 70% to 90% by volume of a viscous oil and 30%-10% of the immiscible solvent. Immiscible solvent for purposes of this invention is defined as a solvent which is substantially incapable of forming a uniform mixture with the oil phase at ambient conditions. The term substantially means that no more than 20%, preferably no more than 10%, most preferably no more than 5% of the solvent will be capable of forming a uniform mixture with the oil phase. The immiscible solvent may be water, short chained ($C_1$-$C_5$) alcohols such as methanol, other solvents known in the art, or mixtures thereof. Most preferably the immiscible solvent is water. The emulsion as formed has distorted oil droplets having mean diameters in the range of 1-500 microns separated by solvent films. Preferably, the oil droplets are in the range of 5-20 microns. More preferably, the oil droplets have mean diameters of about 8-10 microns. The emulsifying surfactants may be non-ionic including ethoxylated alkyl phenols, cationic surfactants including quarternary ammonium compounds, or anionic surfactants such as alkyl, aryl and alkyl/aryl sulphonates and phosphates. The emulsion may also contain salts, and minor amounts of naturally present inorganic materials which may function as catalysts. In addition, water soluble catalysts, insoluble catalysts, and/or organic soluble catalysts may be added to the emulsion to facilitate the production of the desired end product. Furthermore, it is believed that under proper catalytic conditions, the immiscible solvent can participate in a hydrogenation reaction with the heavy oil wherein hydrogen is transferred from solvent to oil phase. Preferably, this reaction is promoted with a phase transfer catalyst such as ruthenium carbonyl. For detailed discussion of the types of surfactants and salts which may be present in the emulsions see U.S. Pat. No. 4,776,977 herein incorporated by reference.

The reaction apparatus should consist of an inlet for the oil/immiscible solvent emulsion, a means for increasing pressure necessary to reach super critical conditions, a reaction vessel with suitable means for heating the emulsion, a means for reducing pressure and temperature, a means for separation of products, and at least one outlet for allowing exit of the upgraded products.

The products of the reaction include light oils such as naphtha and kerosene, gas, heavy oil, and possibly $H_2O$ or coke. For purposes of the present invention, gas is defined as butane and lighter species, light oil is defined as pentane to 1000° F. boiling point oil, and heavy oil is defined as liquids boiling above 1000° F. The reaction takes place under conditions sufficient to maintain a fluid density of from 0.05–0.5 grams/cc.

The invention is illustrated below with specific reference to the accompanying drawing.

In FIG. 1, the heavy hydrocarbon and immiscible solvent emulsion is supplied by line 1 to surge drum 3. Line 5 transports the emulsion to high pressure pump 7, where the emulsion is pressurized to super critical levels. Line 9 transports the pressurized emulsion to the upgrading reactor 11, where the emulsion is heated to critical temperatures before release through pressure reduction valve 15, followed by transport through line 17 into fractionator 19. Fractionator 19, is equipped with outlet lines 21, 23, 25 and 27 located at different levels in fractionator 19. Each outlet line may include a condenser 29. Line 21 transports naphtah while line 23 carreis kerosene. Line 25 carries light gas oil and line 27 transports the residue water, heavy oil and coke, if present, to storage tank 33. Outlet lines 21, 23 and 25 may be connected to storage tanks which are not shown.

It should be understood that the embodiment of the present invention depicted in FIG. 1 is for illustrative purposes only. For example, fractionator 21 can be adapted to have fewer or more separation zones and exit lines resulting in increased or decreased separation of hydrocarbon species. In addition, any conventional separation device known in the art as suitable for separation of hydrocarbon mixtures may be substituted for fractionator 19.

Preferably, the reaction begins with an emulsion of oil and water in which the oil consists of heavy oil, with a ratio of hydrogen to carbon of about 1.1/1 to about 1.5/1. The products from the reaction consist of hydrocarbons, preferably with a hydrogen to carbon ratio of about 1.5/1 to about 2.0/1.

Preferably, the fluid/emulsion in the reaction chamber is at a density of from 0.05–0.50 g/cc. More preferably, the fluid density is from 0.1–0.3 g/cc.

Furthermore, the reaction in furnace 11 (generally pyrolysis) should be at a minimum temperature of about the critical point of the immiscible fluid used to form the emulsion. For water/oil emulsions the reaction temperature is between 350°–1,000° C., preferably between 450°–500° C.

In a further embodiment of the present invention, the resultant heavy oil is collected after fractionation or other means of separation and combined with a fresh immiscible solvent and surfactant to form a new emulsion suitable as a combustion fuel or for re-upgrading according to the process of the present invention. The resultant heavy oil may also be reemulsified in the residual solvent and emulsifier or a combination of residual and fresh solvents and/or emulsifiers.

As a further example of the process of the present invention, Table 1 displays the effectiveness of the present invention's upgrading process (Dense Phase Reaction) in comparison with traditional coking reactions (Delay Coker).

TABLE I

| REACTION | COKER | DENSE PHASE | | | |
|---|---|---|---|---|---|
| Temperature | 500° C. | 500° C. | | | |
| Pressure P.S.I.G. | ~1 ATM | 3000–5000 | | | |
| Reaction Time Minutes | 30 | 3 | 5 | 7 | 9 |
| Weight % Gas | 15 | 1 | 5 | 17 | 24 |
| Weight % Light Oil | 31 | 44 | 55 | 59 | 52 |
| Weight % Heavy Oil | 14 | 38 | 22 | 5 | 1 |
| Weight % Coke | 40 | 17 | 18 | 19 | 23 |

These results indicate that dense phase conditions of the present invention for upgrading heavy oil, bitumen, tar sands and shale oil provide greater light oil production with reduced coke than traditional coking reactions.

Thus it is apparent that there has been provided, in accordance with the invention a process that fully satisfies the object, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A process for upgrading heavy oils to light oils comprising forming an emulsion comprising heavy oils and an immiscible solvent, heating said emulsion under supercritical pressure to at least about its critical temperature to convert at least a portion of said heavy oils to an upgraded product containing light oils.

2. The process of claim 1, further comprising the step of recovering said light oils from said upgraded product.

3. The process of claim 2, wherein said recovering step is performed by fractionating said upgraded product to obtain said light oils.

4. The process of claim 3, further comprising, reducing said pressure prior to fractionating said upgraded product.

5. The process of claim 2, further comprising, recovering the remaining heavy oils from said upgraded product.

6. The process of claim 1, wherein said emulsion contains a salt.

7. The process of claim 1, wherein said immiscible solvent is selected from the group consisting of water, short chained alcohols, or mixtures thereof.

8. The process of claim 1, wherein said immiscible solvent is water.

9. The process of claim 1, wherein said heavy oil in said emulsion has a molecular ratio from about 1.1/1 to about 1.5/1 hydrogen to carbon.

10. The process of claim 1, wherein said light oils have a molecular ratio from about 1.5/1 to about 2.0/1 hydrogen to carbon.

11. The process of claim 1, wherein said light oils comprise naphtha, kerosene, and gas.

12. The process of claim 5, wherein said heavy oils contain coke.

13. The process of claim 1, wherein said upgrading process occurs in an upgrading reactor.

14. The process of claim 13, wherein said heating and pressurizing occur in an upgrading reactor.

15. The process of claim 8, wherein said temperature is in the range of from about 350° C. to about 1,000° C.

16. The process of claim 8, wherein said temperature is in the range of from about 450° C. to about 500° C.

17. The process of claim 1, wherein said heavy oil in said emulsion comprises heavy oil droplets having a diameter of about 1–500 microns.

18. The process of claim 17, wherein said droplets have a diameter of about 5–20 microns.

19. The process of claim 18, wherein said droplets have a diameter of about 8–10 microns.

20. The process of claim 13, wherein the fluid density of the liquid emulsion in said reactor is from about 0.05–0.5 g/cc.

21. The process of claim 20, wherein the fluid density of the liquid emulsion in said reactor is from about 0.1–0.3 g/cc.

22. The process of claim 1, wherein said emulsion contains a catalyst.

23. The process of claim 22, wherein said catalyst is a phase transfer catalyst to facilitate hydrogen transfer from solvent to oil.

24. The process of claim 23, wherein said catalyst is ruthenium carbonyl.

25. The process of claim 5, wherein said heavy oil products are re-emulsified in an immiscible solvent to produce a combustible fuel.

26. The process of claim 23, wherein a surfactant is added to facilitate said emulsion.

* * * * *